US010176793B2

(12) United States Patent
Hsu et al.

(10) Patent No.: US 10,176,793 B2
(45) Date of Patent: Jan. 8, 2019

(54) METHOD, ACTIVE NOISE CONTROL CIRCUIT, AND PORTABLE ELECTRONIC DEVICE FOR ADAPTIVELY PERFORMING ACTIVE NOISE CONTROL OPERATION UPON TARGET ZONE

(71) Applicant: MEDIATEK INC., Hsin-Chu (TW)

(72) Inventors: Chao-Ling Hsu, Hsinchu (TW); Yiou-Wen Cheng, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 15/653,506

(22) Filed: Jul. 18, 2017

(65) Prior Publication Data

US 2018/0233122 A1 Aug. 16, 2018

Related U.S. Application Data

(60) Provisional application No. 62/458,588, filed on Feb. 14, 2017.

(51) Int. Cl.

| | |
|---|---|
| ***G10K 11/178*** | (2006.01) |
| ***H04R 3/00*** | (2006.01) |
| ***H04R 1/10*** | (2006.01) |

(52) U.S. Cl.

CPC ..... *G10K 11/178* (2013.01); *G10K 11/17823* (2018.01); *G10K 11/17854* (2018.01); *G10K 11/17881* (2018.01); *H04R 1/1083* (2013.01); *H04R 3/002* (2013.01); *H04R 3/005* (2013.01); *G10K 2210/1081* (2013.01); *G10K 2210/3025* (2013.01); *H04R 2227/001* (2013.01); *H04R 2410/05* (2013.01); *H04R 2499/11* (2013.01)

(58) Field of Classification Search

CPC ..... G10K 11/178; G10K 11/1788; H04R 1/1083; H04R 3/002; H04R 3/005

USPC ..... 381/56, 58, 71.1, 71.11, 71.12, 71.14, 381/71.2, 71.6, 71.8

See application file for complete search history.

(56) References Cited

U.S. PATENT DOCUMENTS

| | | | | |
|---|---|---|---|---|
| 5,222,148 | A | 6/1993 | Yuan | |
| 5,359,662 | A | 10/1994 | Yuan | |
| 5,427,102 | A | 6/1995 | Shimode | |
| 6,766,292 | B1 | 7/2004 | Chandran | |
| 2003/0055654 | A1* | 3/2003 | Oudeyer | G10L 13/033 704/275 |
| 2006/0035593 | A1 | 2/2006 | Leeds | |
| 2010/0131269 | A1* | 5/2010 | Park | G10K 11/178 704/233 |
| 2011/0007907 | A1* | 1/2011 | Park | G10K 11/178 381/71.8 |
| 2011/0299695 | A1 | 12/2011 | Nicholson | |
| 2013/0028440 | A1* | 1/2013 | Perkmann | G10K 11/178 381/94.1 |

(Continued)

*Primary Examiner* — William A Jerez Lora
(74) *Attorney, Agent, or Firm* — Winston Hsu

(57) ABSTRACT

A method for performing active noise control upon a target zone includes: using an adaptive filtering circuit to receive at least one microphone signal obtained from a microphone; and, dynamically compensating at least one coefficient of the adaptive filtering circuit to adjust a frequency response of the adaptive filtering circuit according to an energy distribution of the at least one microphone signal, so as to make the adaptive filtering circuit receive the at least one microphone signal to generate a resultant anti-noise signal to the target zone based on the dynamically adjusted frequency response.

7 Claims, 6 Drawing Sheets

(56) References Cited

U.S. PATENT DOCUMENTS

2013/0156214 A1* 6/2013 Murthy ..... G10K 11/002
381/71.6
2013/0301846 A1* 11/2013 Alderson ..... H04R 3/002
381/71.7

* cited by examiner

METHOD, ACTIVE NOISE CONTROL CIRCUIT, AND PORTABLE ELECTRONIC DEVICE FOR ADAPTIVELY PERFORMING ACTIVE NOISE CONTROL OPERATION UPON TARGET ZONE

CROSS REFERENCE TO RELATED APPLICATIONS

This application claims priority of U.S. provisional application Ser. No. 62/458,588 filed on Feb. 14, 2017, which is entirely incorporated herein by reference.

BACKGROUND

The invention relates to an adaptive active noise control mechanism, and more particularly to a method, active noise control circuit, and portable electronic device for adaptively or dynamically performing active noise control operation upon a target zone such as a quiet zone of a user's ear.

Generally speaking, a conventional active noise cancellation scheme is useful to cancel low frequency noise and now is widely used in earphones for users to have better listening/communication experience. However, it usually generates some high frequency noise which can be heard by users (Hiss noise) in the same time. In order to attenuate Hiss noise, the conventional active noise cancellation scheme may adopt a fixed low-pass filter with a flat frequency response to remove the high frequency part of an anti-noise signal which is used for cancel the Hiss noise. Nevertheless, the fixed LPF with flat frequency response introduces additional latency (side effect) to the conventional active noise cancellation system. The latency inevitably degrades the performance of the conventional active noise cancellation system especially when the system is nearly or completely non-causal. In addition, the fixed low-pass filter with a flat frequency response cannot be used for effectively reduce or cancel different types of noises, and thus side effect is also introduced.

SUMMARY

Therefore one of the objectives of the invention is to provide an active noise control (ANC) system circuit, method, and corresponding portable electronic device for adaptively or dynamically performing active noise control operation for a target zone, to solve the above-mentioned problems.

According to embodiments of the invention, an ANC system circuit for performing active noise control upon a target zone is disclosed. The ANC system circuit comprises an adaptive filtering circuit and a controlling circuit. The adaptive filtering circuit is configured for receiving at least one microphone signal obtained from at least one microphone. The controlling circuit is coupled to adaptive filtering circuit and configured for dynamically compensating at least one coefficient of the adaptive filtering circuit to adjust a frequency response of the adaptive filtering circuit according to an energy distribution of the at least one microphone signal, so as to make the adaptive filtering circuit receive the at least one microphone signal to generate a resultant anti-noise signal to the target zone based on the dynamically adjusted frequency response.

According to the embodiments, a method for performing active noise control upon a target zone is disclosed. The method comprises: using an adaptive filtering circuit to receive at least one microphone signal obtained from at least one microphone; dynamically compensating at least one coefficient of the adaptive filtering circuit to adjust a frequency response of the adaptive filtering circuit according to an energy distribution of the at least one microphone signal, so as to make the adaptive filtering circuit receive the at least one microphone signal to generate a resultant anti-noise signal to the target zone based on the dynamically adjusted frequency response.

According to the embodiments, a portable electronic device for performing active noise control upon a target zone is disclosed. The portable electronic device comprises at least one microphone, an adaptive filtering circuit, and a controlling circuit. The adaptive filtering circuit is configured for receiving at least one microphone signal obtained from the at least one microphone. The controlling circuit is coupled to adaptive filtering circuit and configured for dynamically compensating at least one coefficient of the adaptive filtering circuit to adjust a frequency response of the adaptive filtering circuit according to an energy distribution of the at least one microphone signal, so as to make the adaptive filtering circuit receive the at least one microphone signal to generate a resultant anti-noise signal to the target zone based on the dynamically adjusted frequency response.

According to the embodiments, by adaptively/dynamically adjusting the frequency response of adaptive filtering circuit based on the detected energy/magnitude distribution to generate the resultant anti-noise signal, the proposed mechanism in the embodiments can effectively reduce out-band noise at the high frequency band for the quiet zone as well as avoid degradation of ANC noise attenuation performance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
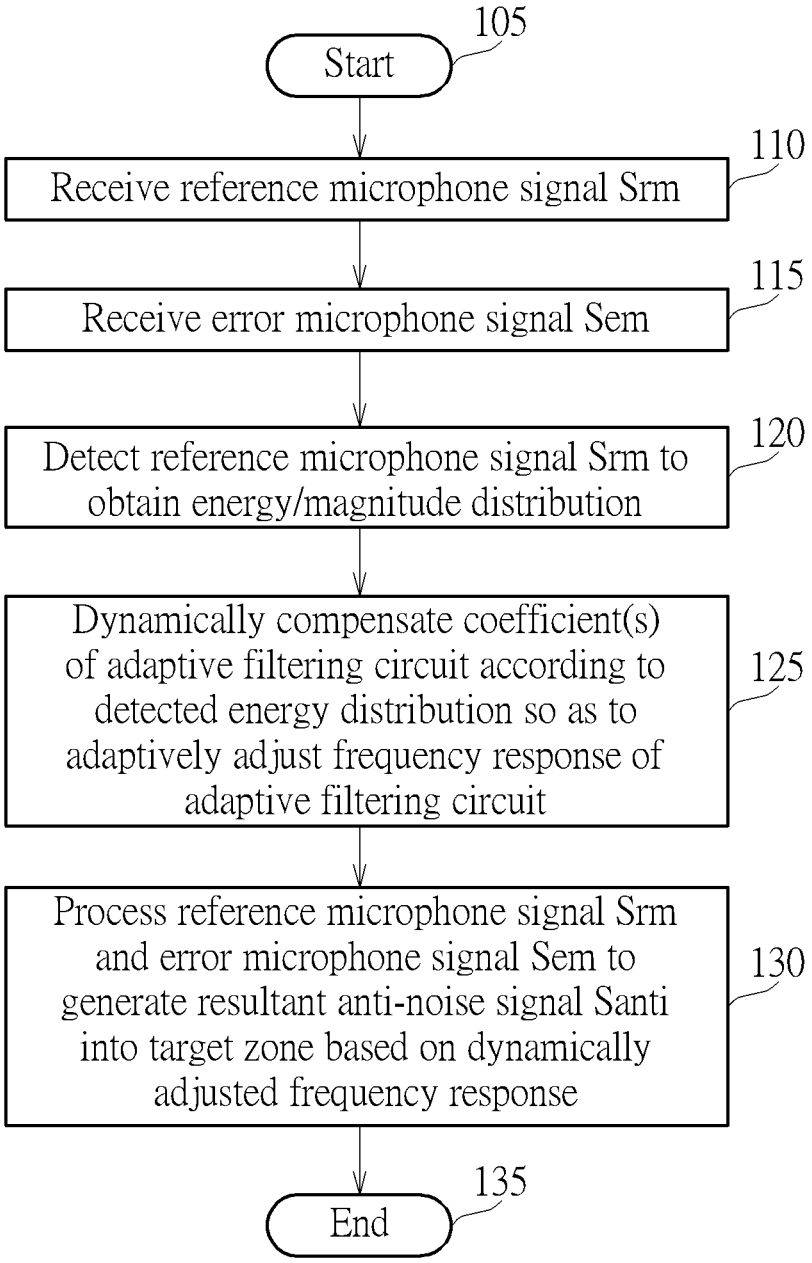
FIG. 1 is a flowchart of a method for adaptively or dynamically performing active noise control (ANC) operation upon a target zone for a user according to a first embodiment of the invention.
Figure 2:
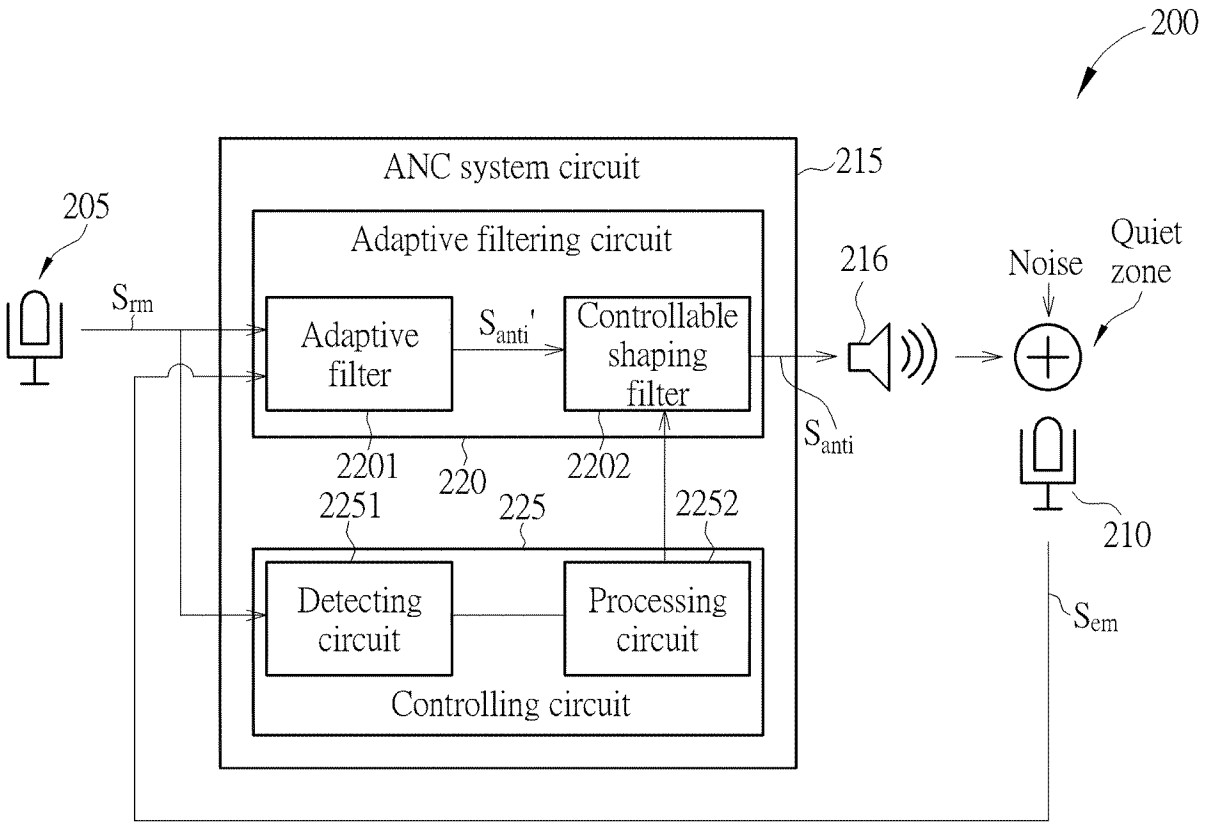
FIG. 2 is a block diagram of a portable electronic device implemented with the flowchart of FIG. 1.

FIG. 1 is a flowchart of a method for adaptively or dynamically performing active noise control (ANC) operation upon a target zone for a user according to a first embodiment of the invention. FIG. 2 is a block diagram of a portable electronic device 200 implemented with the flowchart of FIG. 1. In the embodiments, the target zone means a quiet zone of an ear of the user, and the method is arranged to perform ANC operation upon such quiet zone so that noise in the quiet zone can be reduced or cancelled as far as possible, i.e. active noise cancellation or adaptive noise control. The portable electronic device 200 such as a mobile phone or smart phone, and comprises a reference microphone 205, an error microphone 210, and an ANC system circuit 215. The reference microphone 205 is configured out of the target zone and used for receiving or detecting outside noise to generate a reference microphone signal Srm. The error microphone 210 is configured in the target zone and used for receiving or detecting inside noise (e.g. in-ear noise) to generate an error microphone signal Sem. For example, if the device 200 is a smart phone, the error microphone 210 and quiet zone may be configured together with a speaker 216 of the smart phone, and the reference microphone 205 may be configured at the back of the smart phone; however, this is not meant to be a limitation.

Specifically, the ANC system circuit 215 of the embodiment comprises an adaptive filtering circuit 220 and a controlling circuit 225. Provided that substantially the same result is achieved, the steps of the flowchart shown in FIG. 1 need not be in the exact order shown and need not be contiguous, that is, other steps can be intermediate. Steps are detailed in the following:

Step 105: Start;

Step 110: Receive the reference microphone signal Srm from the reference microphone 205 by using the adaptive filtering circuit 220;

Step 115: Receive the error microphone signal Sem from the error microphone 210 by using the adaptive filtering circuit 220;

Step 120: Use the controlling circuit 225 to detect the reference microphone signal Srm to obtain an energy/magnitude distribution of the signal Srm;

Step 125: Use the controlling circuit 225 to dynamically compensate at least one coefficient of the adaptive filtering circuit 220 according to the detected energy distribution so as to adaptively adjust the frequency response of adaptive filtering circuit 220;

Step 130: Use the adaptive filtering circuit 220 to receive/process the reference microphone signal Srm and the error microphone signal Sem to generate a resultant anti-noise signal Santi into the target zone based on the dynamically adjusted frequency response in Step 125 so as to reduce or cancel the noise of quiet zone; and Step 135: End.

Figure 3:
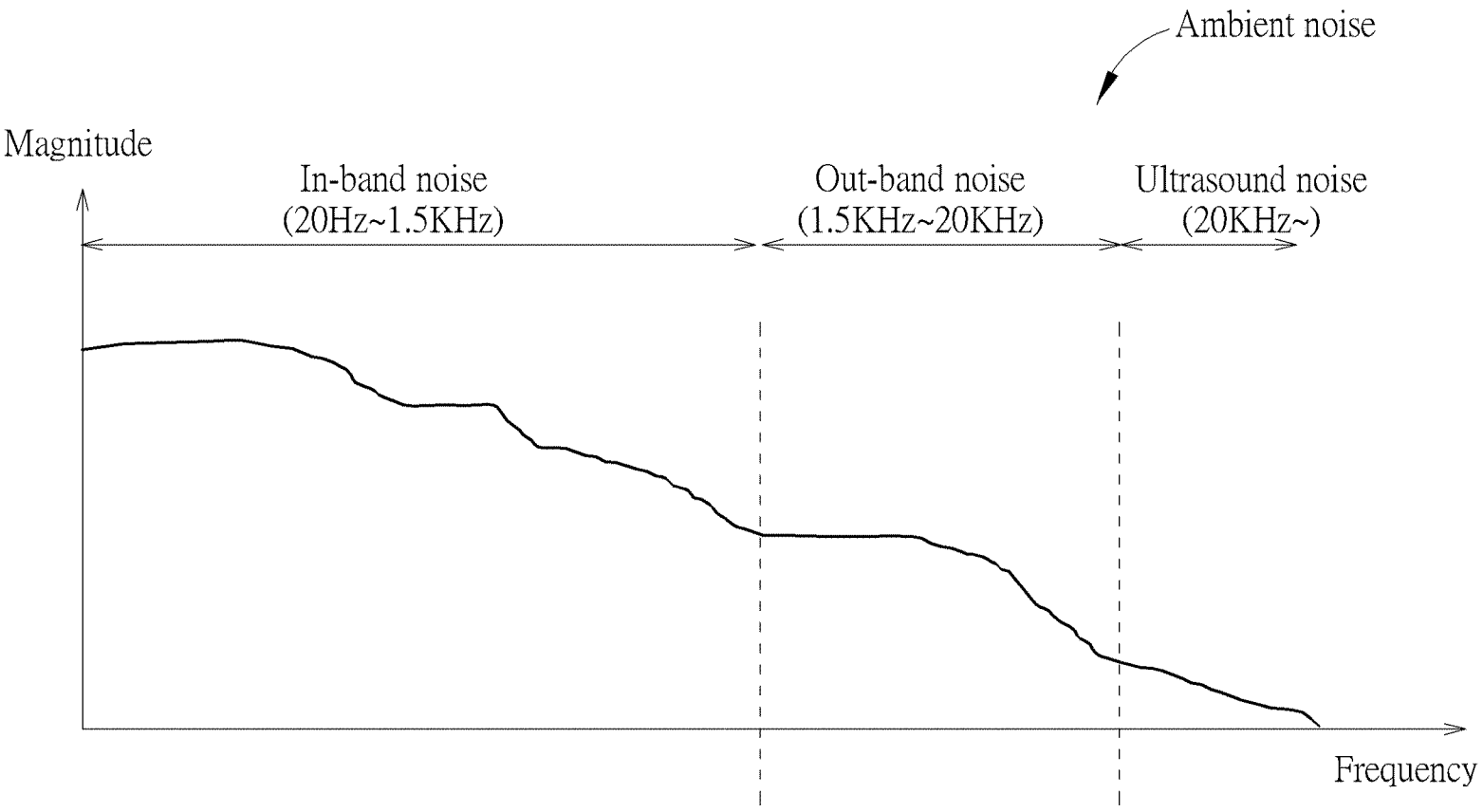
FIG. 3 is a simplified diagram illustrating an example of the frequency response of an ambient noise signal.

A sound frequency band which can be heard by human ears is usually at the frequency range of 20 Hz-20 KHz. FIG. 3 is a simplified diagram illustrating an example of the frequency response of an ambient noise signal. The ambient noise signal can be generally divided into the in-band noise, out-band noise, and ultrasound noise. The in-band noise can be represented by a low frequency band of the sound frequency band 20 Hz-20 KHz, and for example the low frequency band is at the range of 20-1.5 KHz (but not limited). The out-band noise can be represented by a high frequency band of the sound frequency band 20 Hz-20 KHz, and for example the high frequency band is at the range of 1.5 KHz-20 KHz (but not limited). The ultrasound noise equivalently cannot be heard by the user's ear. As mentioned above, the conventional ANC scheme may be able to attenuate in-band noise at the low frequency band but cannot effectively attenuate out-band noise at the high frequency band since the operation frequency of conventional ANC circuit is not configured as a higher frequency rate when considering low circuit costs and sound signals' characteristics such as the valid range of destructive interference and the length of the sound signals, and thus the performance of the conventional ANC circuit inevitably is significantly degraded at the high frequency band.

The conventional ANC scheme inevitably adds more noise components to the out-band noise of high frequency band for the quiet zone when suppressing the in-band noise of the low frequency band since the conventional ANC scheme additionally adds more noise to the high frequency band when suppresses more in-band noise. Compared to the conventional ANC scheme, by adaptively/dynamically adjusting the frequency response of adaptive filtering circuit 220 based on the detected energy/magnitude distribution to generate the resultant anti-noise signal Santi, the ANC system circuit 215 and method in the embodiment are able to effectively control or suppress the noise components additionally added by the conventional ANC scheme to the high frequency band for the quiet zone as well as avoid degradation of ANC noise attenuation performance.

In practice, the adaptive filtering circuit 220 comprises an adaptive filter 2201 with an adaptive algorithm and a controllable shaping filter 2202. The adaptive filter 2201 is implemented with the adaptive algorithm such as Filtered-x Least Mean Square (FxLMS-based), Filtered-u Least Mean Square (FuLMS-based), or Normalized Least Mean Squares (NLMS-based) adaptation algorithms (but not limited), and so on. The adaptive filter 2201 is arranged for generating a preliminary anti-noise signal Santi' based on the adaptive algorithm according to the reference microphone signal Srm and the error microphone signal Sem. The controllable shaping filter 2202 is coupled to the adaptive filter 2201 and configured for receiving the preliminary anti-noise signal Santi' to generate the resultant anti-noise signal Santi to the target zone. Since the whole frequency response of adaptive filtering circuit 220 is composed of frequency responses of adaptive filter 2201 and controllable shaping filter 2202, dynamically adjusting the frequency response of controllable shaping filter 2202 can equivalently adjust or compensate the frequency response of adaptive filtering circuit 220. In this embodiment, the whole frequency response of adaptive filtering circuit 220 is dynamically adjusted by adjusting the frequency response of controllable shaping filter 2202. That is, the frequency response of adaptive filter 2201 can be configured as a fixed response (but not limited); the controlling circuit 225 in other embodiments may be arranged to dynamically adjust the frequency response of adaptive filter 2201. The frequency response of controllable shaping filter 2202 is adjustable/controllable and is dynamically determined/controlled by the controlling circuit 225 according to the energy/magnitude distribution of the reference microphone signal. In practice, the controlling circuit 225 can dynamically compensate at least one coefficient of controllable shaping filter 2202 based on the energy distribution of the reference microphone signal, to adaptively adjust the frequency response of controllable shaping filter 2202.

In practice, the controlling circuit 225 comprises a detecting circuit 2251 and a processing circuit 2252. The detecting circuit 2251 is configured for detecting energy of the reference microphone signal Srm to obtain the energy distribution of the reference microphone signal Srm. The processing circuit 2252 such as a DSP circuit is coupled to detecting circuit 2251 and is configured for identifying the detected energy distribution to determine/select a noise type among a plurality of noise types and for dynamically compensating the at least one coefficient of the controllable shaping filter 2202 based on the selected noise type.

Specifically, in this embodiment, the detecting circuit 2251 2251 may be implemented to comprise two specific filters including a first specific filter with a first pass-band to detect energy of the in-band noise and a second specific filter with a second pass-band to detect energy of the out-band noise. For example, the first specific filter may be a low-pass filter, and the second specific filter may be a band-pass filter (but not limited). In other embodiments, the detecting circuit 2251 may be merely designed to measure the energy of ambient noise and may exclude the low-pass filter or band-pass filter.

The controllable shaping filter 2202 can be designed or configured to be with multiple kinds of frequency responses. Assuming that the controllable shaping filter 2202 is with two kinds of frequency responses, for compensating at least one coefficient of the controllable shaping filter 2202, the processing circuit 2252 is arranged for compensating at least one coefficient of the controllable shaping filter as a first coefficient corresponding to a first frequency response when energy of a high frequency signal component of the energy distribution is greater than energy of a low frequency signal component of the energy distribution (i.e. the magnitude of out-band noise is greater than that of in-band noise). Also, the processing circuit 2252 is arranged for compensating the at least one coefficient of the controllable shaping filter as a second coefficient corresponding to a second frequency response when the energy of the high frequency signal component is smaller than the energy of the low frequency signal component (i.e. the magnitude of out-band noise is smaller than that of in-band noise). That is, the processing circuit 2252 adaptively adjust the frequency response of controllable shaping filter 2202 according to the currently received noise magnitude (in-band noise magnitude and out-band noise magnitude).

Figure 4:
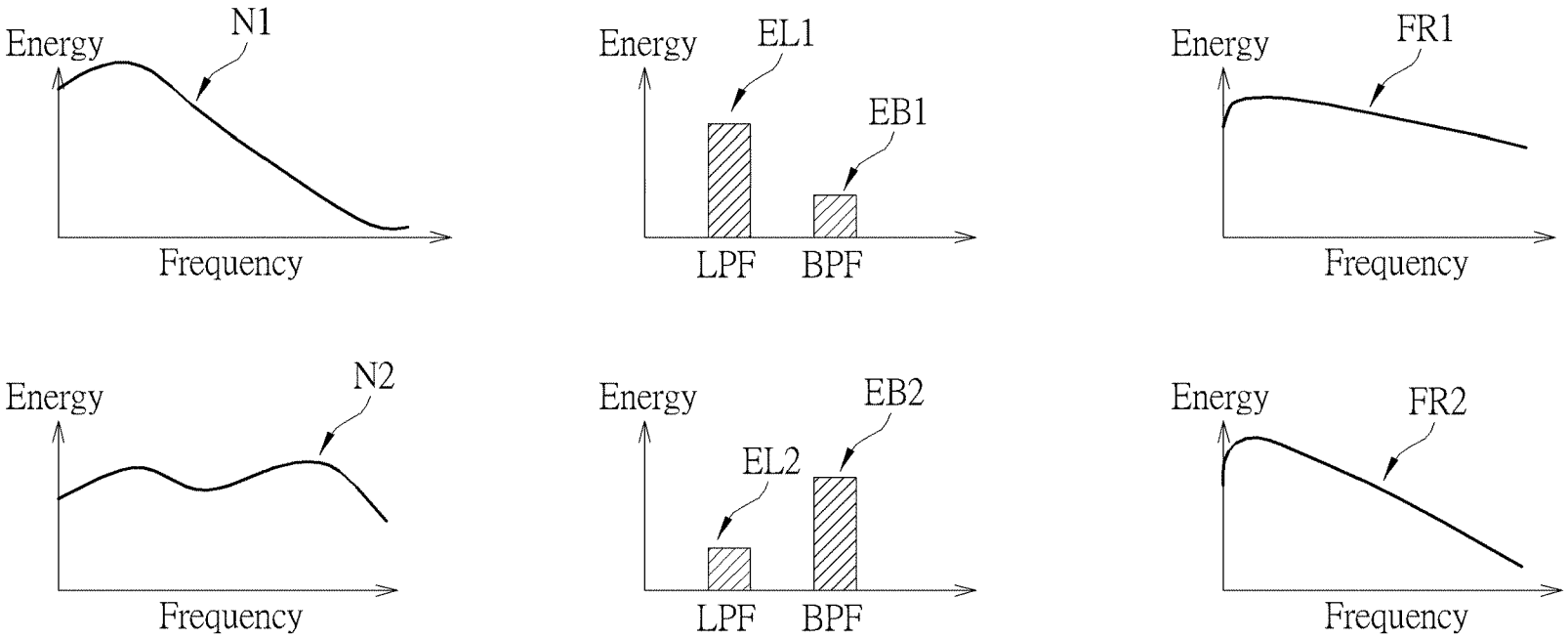
FIG. 4 is a diagram illustrating examples of operations of controlling circuit as shown in FIG. 2.

FIG. 4 is a diagram illustrating examples of operations of controlling circuit 225 as shown in FIG. 2. In a first example, the currently received reference microphone signal Srm actually corresponds to a first noise type N1 which indicates that such reference microphone signal Srm has a greater energy level at its low frequency components than its high frequency components, as shown in FIG. 4. The detecting circuit 2251 can use the low-pass filter and band-pass filter to detect the reference microphone signal Srm to obtain and generate the energy distribution result which shows that the low-pass filter measures a greater energy level EL1 while the band-pass filter measures a smaller energy level EB1. The processing circuit 2252 receives and refers to the greater energy level EL1 and smaller energy level EB1 to determine that the currently received reference microphone signal Srm corresponds to the first noise type N1 (i.e. selects N1 among the noise types N1 and N2), and then compensates the coefficient(s) of controllable shaping filter 2202 as coefficient(s) corresponding to the frequency response FR1 having the slope which drops more slowly than the frequency response FR2 if the controllable shaping filter 2202 is implemented by using a controllable low-pass filter. In this situation, the controllable shaping filter 2202 is equivalent to a low-pass filter having the frequency response FR1 which can be used for passing the low frequency signal components associated with in-band noise in the preliminary anti-noise signal Santi' and passing high frequency signal components associated with out-band in the preliminary anti-noise signal Santi' with less attenuation, to generate the resultant anti-noise signal Santi. This can effectively cancel or reduce noise of the quiet zone and significantly improve the performance of ANC operation. In other words, if energy of the ambient noise is concentrated in in-band, the frequency response can be determined as a flat response such as FR1 with less circuit latency since the side effect is out-band is weak and may be masked by the in-band noise.

Alternatively, in a second example of FIG. 4, the currently received reference microphone signal Srm actually corresponds to a second noise type N2 which indicates that such reference microphone signal Srm has a greater energy level at its high frequency components than its low frequency components, as shown in FIG. 4. The detecting circuit 2251 can use the low-pass filter and band-pass filter to detect the reference microphone signal Srm to obtain and generate the energy distribution result which shows that the low-pass filter measures a smaller energy level EL2 while the high-pass filter measures a greater energy level EB2. The processing circuit 2252 receives and refers to the smaller energy level EL2 and greater energy level EB2 to determine that the currently received reference microphone signal Srm corresponds to the second noise type N2 (i.e. selects N2 among the noise types N1 and N2), and then compensates the coefficient(s) of controllable shaping filter 2202 as coefficient(s) corresponding to the frequency response FR2 having the slope which drops more rapidly than the frequency response FR1 if the controllable shaping filter 2202 is implemented by using a controllable low-pass filter. That is, in this situation, the controllable shaping filter 2202 is equivalent to a low-pass filter having the frequency response FR2 which can be used for passing the low frequency signal components associated with in-band noise in the preliminary anti-noise signal Santi' and passing high frequency signal components associated with out-band in the preliminary anti-noise signal Santi' with more attenuation, to generate the resultant anti-noise signal Santi. This can effectively avoid degradation of the ANC performance even though the user may hear little noise caused due to the attenuated high frequency components. In other words, if the energy of ambient noise is concentrated in out-band or equally distributed in in-band and out-band, the frequency response can be determined as a sharper response such as FR2 with more circuit latency, so as to compensate the side-effect.

Further, in practice, the processing circuit 2252 can be configured to calculate an energy ratio of the energy of low frequency signal components divided by that of the high frequency signal components. If the energy ratio is greater than one (but not limited), the processing circuit 2252 is arranged to determine or control the controllable shaping filter 2202 as a low-pass filter having the frequency response slope which drops more slowly. Alternatively, if the energy ratio is smaller than one, the processing circuit 2252 is arranged to determine or control the controllable shaping filter 2202 as a low-pass filter having the frequency response slope which drops more rapidly.

Further, in another embodiment, the controllable shaping filter 2202 may be designed to comprise two kinds of frequency responses corresponding to other filters with similar functionalities such as a low-pass filter and a band-stop filter (or a notch filter). The band-stop filter can be used to attenuate energy for a certain frequency. If the energy of the low frequency components of reference microphone signal Srm is smaller than that of the high frequency components, the processing circuit 2252 is arranged to control or compensate the coefficient(s) of controllable shaping filter 2202 as coefficient(s) corresponding to a frequency response of the band-stop filter, so that the controllable shaping filter 2202 is equivalent to the band-stop filter which can be used for passing the low frequency signal components in the preliminary anti-noise signal Santi' and attenuating or rejecting the high frequency signal components in the preliminary anti-noise signal Santi', to generate the resultant anti-noise signal Santi to the quiet zone. This effectively avoids degradation of the ANC performance even though the user may hear little noise caused due to the attenuated high frequency components.

In addition, if the processing circuit 2252 determines that the energy of high frequency components of reference microphone signal Srm is smaller than that of low frequency components, the processing circuit 2252 is arranged to control or compensate the coefficient(s) of controllable shaping filter 2202 as coefficient(s) corresponding to a frequency response of the low-pass filter, so that the controllable shaping filter 2202 is equivalent to the low-pass filter which can be used for passing the low frequency signal components in the preliminary anti-noise signal Santi' and passing the high frequency signal components in the preliminary anti-noise signal Santi' with less attenuation, to generate the resultant anti-noise signal Santi to the quiet zone. This can effectively cancel or reduce noise of the quiet zone and significantly improve the ANC performance.

It should be noted that the controllable shaping filter 2202 has at least two different frequency responses corresponding to different filters and can use a corresponding frequency response to process the preliminary anti-noise signal Santi' to generate the resultant anti-noise signal Santi based on the control of the processing circuit 2252.

Figure 5:
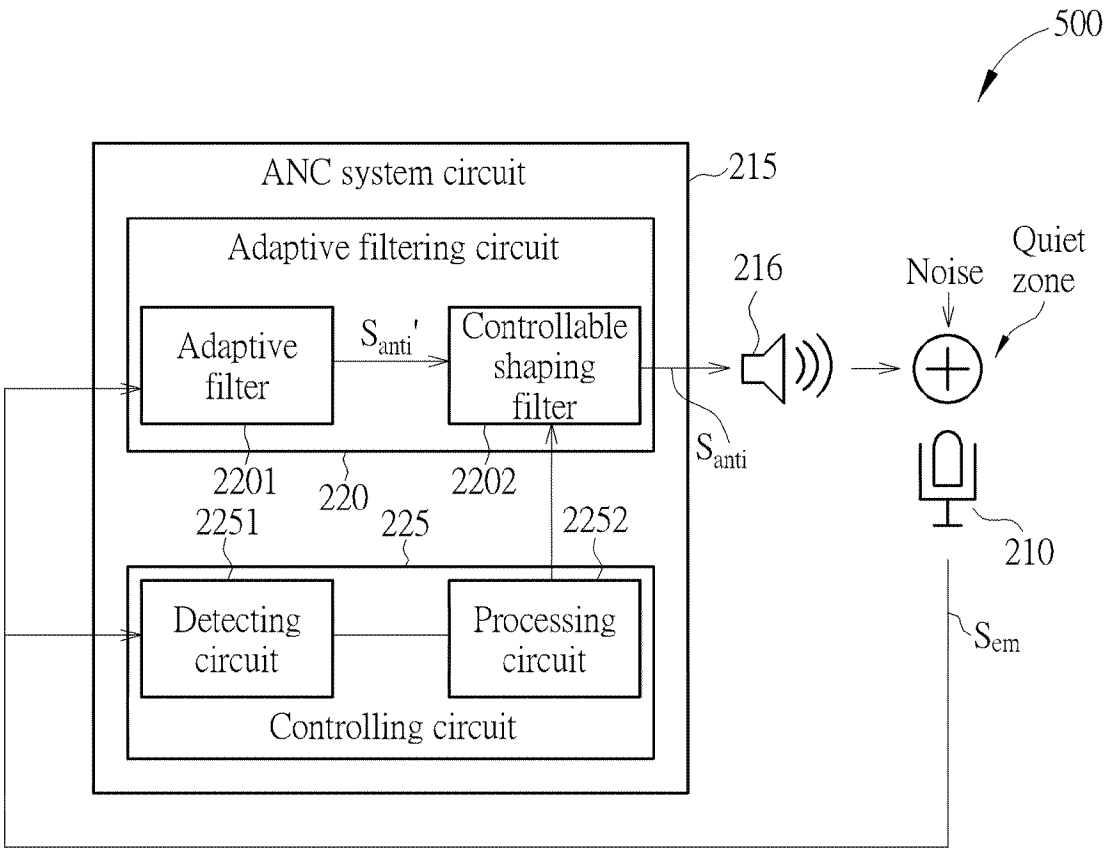
FIG. 5 is a block diagram of a portable electronic device according to the second embodiment of the invention.
Figure 6:
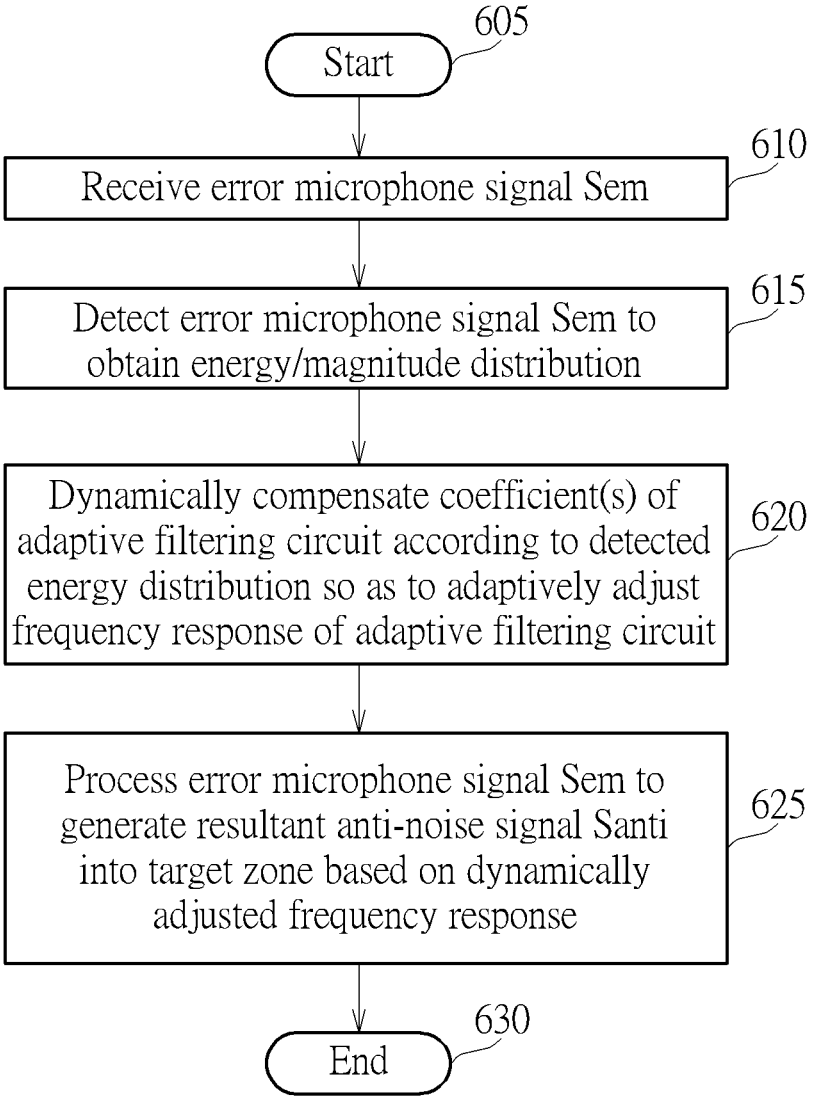
FIG. 6 is a flowchart of a method for adaptively or dynamically performing ANC operation upon a target zone for a user according to the second embodiment of the invention.

Further, in a second embodiment, the ANC system circuit can be arranged for adaptively or dynamically performing ANC operation upon the quiet zone by referring to the energy distribution of the error microphone signal without referencing the reference microphone signal. FIG. 5 is a block diagram of a portable electronic device 500 according to the second embodiment of the invention. FIG. 6 is a flowchart of a method for adaptively or dynamically performing active noise control (ANC) operation upon a target zone for a user according to the second embodiment of the invention. Provided that substantially the same result is achieved, the steps of the flowchart shown in FIG. 6 need not be in the exact order shown and need not be contiguous, that is, other steps can be intermediate. Steps are detailed in the following:

Step 605: Start;

Step 610: Receive the error microphone signal Sem from the error microphone 210 by using the adaptive filtering circuit 220;

Step 615: Use the controlling circuit 225 to detect the error microphone signal Sem to obtain an energy/magnitude distribution of the signal Sem;

Step 620: Use the controlling circuit 225 to dynamically compensate at least one coefficient of the adaptive filtering circuit 220 according to the detected energy distribution so as to adaptively adjust the frequency response of adaptive filtering circuit 220;

Step 625: Use the adaptive filtering circuit 220 to receive/process the error microphone signal Sem to generate the resultant anti-noise signal Santi into the target zone based on the dynamically adjusted frequency response in Step 620 so as to reduce or cancel the noise of quiet zone; and Step 630: End.

Compared to portable electronic device 200, the portable electronic device 500 may be designed to exclude the reference microphone or may include the reference microphone but is designed to not to reference the reference microphone signal. The portable electronic device 500 such as a mobile phone or smart phone, and comprises the error microphone 210 and the ANC system circuit 215. The error microphone 210 is configured in the target zone and used for receiving or detecting inside noise (e.g. in-ear noise) to generate an error microphone signal Sem. For example, if the device 500 is a smart phone, the error microphone 210 and quiet zone may be configured together with a speaker 216 of the smart phone; however, this is not meant to be a limitation. In the second embodiment, the adaptive filtering circuit 220 is arranged for using the adaptive filter 2201 to receive the error microphone signal Sem from the error microphone 210 to generate the preliminary anti-noise signal Santi' and using the controllable shaping filter 2202 to receive/process the preliminary anti-noise signal Santi' to generate the resultant anti-noise signal Santi to the quiet zone. The controlling circuit 225 is arranged for using the detecting circuit 2251 to detect the error microphone signal Sem to obtain an energy/magnitude distribution of the signal Sem and using the processing circuit 2252 to dynamically compensate at least one coefficient of controllable shaping filter 2202 according to the detected energy distribution so as to adaptively adjust the frequency response of adaptive filtering circuit 220. Thus, the adaptive filtering circuit 220 is arranged to receive/process the error microphone signal Sem to generate the resultant anti-noise signal Santi into the target zone based on the dynamically adjusted frequency response so as to reduce or cancel the noise of quiet zone.

According to the first and second embodiments mentioned above, no matter whether an ANC system circuit is implemented with feed-forward, feedback, and/or hybrid circuit structures, by adaptively/dynamically adjusting the frequency response of adaptive filtering circuit based on the detected energy/magnitude distribution of microphone signal(s) to generate the resultant anti-noise signal Santi, the ANC system circuits in the embodiments are able to effectively reduce out-band noise at the high frequency band for the quiet zone as well as avoid degradation of ANC noise attenuation performance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An active noise control (ANC) system circuit for performing active noise control upon a target zone, comprising:

an adaptive filtering circuit, configured for receiving a reference microphone signal obtained from a reference microphone configured out of the target zone and an error microphone signal obtained from an error microphone configured in the target zone; and a controlling circuit, coupled to the adaptive filtering circuit, configured for generating an energy distribution for different frequency signal components of the reference microphone signal and then dynamically compensating at least one coefficient of the adaptive filtering circuit to adjust a frequency response of the adaptive filtering circuit according to the generated energy distribution of the reference microphone signal, so as to make the adaptive filtering circuit receive the reference microphone signal and the error microphone signal to generate a resultant anti-noise signal to the target zone based on the adjusted frequency response;

wherein the adaptive filtering circuit comprises:

an adaptive filter with an adaptive algorithm, configured for generating a preliminary anti-noise signal based on the adaptive algorithm according to the reference microphone signal and the error microphone signal; and a controllable shaping filter, coupled to the adaptive filter, configured for receiving the preliminary anti-noise signal to generate the resultant anti-noise signal to the target zone according to the energy distribution of the reference microphone signal;

wherein the controlling circuit is arranged for:

compensating at least one coefficient of the controllable shaping filter as a first coefficient corresponding to a first frequency response when energy of a high frequency signal component of the energy distribution is greater than energy of a low frequency signal component of the energy distribution; and compensating the at least one coefficient of the controllable shaping filter as a second coefficient corresponding to a second frequency response when the energy of the high frequency signal component is smaller than the energy of the low frequency signal component.

2. The ANC system circuit of claim 1, wherein the controllable shaping filter is a controllable low-pass filter, and a slope of the first frequency response drops more rapidly than a slope of the second frequency response.

3. The ANC system circuit of claim 1, wherein the first frequency response corresponds to a frequency response of a band-stop filter and the second frequency response corresponds to a frequency response of a low-pass filter.

4. The ANC system circuit of claim 1, wherein the controlling circuit comprises:

a detecting circuit, configured for detecting an energy of the reference microphone signal to obtain the energy distribution of the reference microphone signal; and a processing circuit, coupled to detecting circuit, configured for dynamically compensating the at least one coefficient of the controllable shaping filter of the adaptive filtering circuit based on the detected energy distribution.

5. A method for performing active noise control upon a target zone, comprising:

using an adaptive filtering circuit to receive a reference microphone signal obtained from a reference microphone configured out of the target zone and an error microphone signal obtained from an error microphone configured in the target zone;

generating an energy distribution for different frequency signal components of the reference microphone signal; and dynamically compensating at least one coefficient of the adaptive filtering circuit to adjust a frequency response of the adaptive filtering circuit according to the generated energy distribution of the reference microphone signal, so as to make the adaptive filtering circuit receive the reference microphone signal and the error microphone signal to generate a resultant anti-noise signal to the target zone based on the dynamically adjusted frequency response;

wherein the step of using the adaptive filtering circuit to receive the reference microphone signal and the error microphone signal comprises:

providing an adaptive filter with an adaptive algorithm and generating a preliminary anti-noise signal based on the adaptive algorithm according to the reference microphone signal and the error microphone signal; and providing and using a controllable shaping filter to receive the preliminary anti-noise signal to generate the resultant anti-noise signal to the target zone according to the energy distribution of the reference microphone signal;

wherein a first frequency response of the controllable shaping filter corresponds to a frequency response of a band-stop filter and a second frequency response of the controllable shaping filter corresponds to a frequency response of a low-pass filter.

6. The method of claim 5, wherein the step of dynamically compensating the at least one coefficient of the adaptive filtering circuit comprises:

detecting energy of the reference microphone signal to obtain the energy distribution of the reference microphone signal; and dynamically compensating the at least one coefficient of the controllable shaping filter within the adaptive filtering circuit based on the detected energy distribution.

7. A portable electronic device for performing active noise control upon a target zone, comprising:

at least one microphone;

an adaptive filtering circuit, configured for receiving a reference microphone signal obtained from a reference microphone configured out of the target zone and an error microphone signal obtained from an error microphone configured in the target zone; and a controlling circuit, coupled to adaptive filtering circuit, configured for generating an energy distribution for different frequency signal components of the reference microphone signal and then dynamically compensating at least one coefficient of the adaptive filtering circuit to adjust a frequency response of the adaptive filtering circuit according to the generated energy distribution of the reference microphone signal, so as to make the adaptive filtering circuit receive the reference microphone signal and the error microphone signal to generate a resultant anti-noise signal to the target zone based on the dynamically adjusted frequency response;

wherein a first frequency response of a controllable shaping filter of the adaptive filtering circuit corresponds to a frequency response of a band-stop filter and a second frequency response of the controllable shaping filter of the adaptive filtering circuit corresponds to a frequency response of a low-pass filter.

* * * * *